United States Patent [19]

Bunin

[11] Patent Number: 4,911,304

[45] Date of Patent: Mar. 27, 1990

[54] SANDWICH BLISTER PACKAGE FOR TABLETS AND SIMILAR ARTICLES

[75] Inventor: Leonid Bunin, Woodbridge, N.J.

[73] Assignee: Merck & Co., Inc., Rahway, N.J.

[21] Appl. No.: 325,838

[22] Filed: Mar. 20, 1989

[51] Int. Cl.[4] ..... B65D 85/56

[52] U.S. Cl. ..... 206/531; 206/469; 206/532

[58] Field of Search ..... 206/528, 531, 539, 461, 206/467, 468, 469, 471, 484, 828, 820, 532, 538, 529, 530, 524.2, 524.3

[56] References Cited

U.S. PATENT DOCUMENTS

| | | | |
|---|---|---|---|
| 3,331,495 | 7/1967 | Leckzik et al. | 206/531 |
| 3,603,453 | 9/1971 | Serrell et al. | 206/532 |
| 3,659,706 | 5/1972 | Serrell | 206/539 |
| 3,743,084 | 7/1973 | Douglas | 206/539 |
| 4,340,141 | 7/1982 | Fischer | 206/528 |

FOREIGN PATENT DOCUMENTS

| | | | |
|---|---|---|---|
| 2923106 | 12/1980 | Fed. Rep. of Germany | 200/538 |
| 2932285 | 2/1981 | Fed. Rep. of Germany | 206/538 |
| 6600918 | 7/1966 | Netherlands | 206/531 |

*Primary Examiner*—Jimmy G. Foster
*Assistant Examiner*—D. Jenny
*Attorney, Agent, or Firm*—Salvatore C. Mitri; Joseph F. DiPrima

[57] ABSTRACT

There is disclosed a novel sandwich blister package for tablets and similar articles which generally comprises a plastic film having a plurality of heat-formed cavities which contain tablets or similar articles; and, a plastic film/aluminum foil laminate sheet superimposed upon and heat sealed to the plastic film to form a blister card of pre-set size, each blister card being bonded to another blister card so that the aluminum foil forms the outer protective cover with the plastic film sandwiched between them.

7 Claims, 2 Drawing Sheets

SANDWICH BLISTER PACKAGE FOR TABLETS AND SIMILAR ARTICLES

BACKGROUND OF THE INVENTION

Many consumer articles such as prescription medicines are provided in the form of tablets or pills. It is desirable to prolong the shelf life of these articles by protecting them from exposure to air, gas and moisture. Some of these articles are hygroscopic making it necessary to protect them from moisture degradation so that they retain their usefulness over prolonged periods; i.e. shelf life stability, until they are consumed.

In order to accomplish these desirable ends, these tablets and pills are typically contained in what are commonly referred to as blister packages; that is, relatively flat packages having a plurality cavities formed in them from suitable moisture/vapor/gas impervious materials which are sealed to each other. The tablets or pills are carried in the cavities and are protected from moisture/vapor/gas degradation until the protective materials are unsealed to remove the pills or tablets to be consumed.

A typical moisture/vapor/gas impervious blister package currently in commercial use comprises two sheets of protective material, one sheet being a three ply laminate consisting of a flexible plastic film, aluminum foil and a resilient plastic film such as nylon. The aluminum foil ply imparts the desired moisture/vapor/gas barrier protection and is the middle ply of the laminate with the flexible plastic film bonded to one surface of the aluminum foil ply and the resilient plastic film ply bonded to the other surface of the aluminum foil ply. The flexible plastic film, typically a polyvinyl chloride (PVC film, is the innermost ply of the package and serves primarily as a sealant, although it also protects the tablets or pills by preventing them from contacting the aluminum foil ply.

Since the aluminum foil ply used is relatively thin, it can be easily punctured and has a tendancy to tear. Consequently, the resilient plastic film is used to protect the aluminum foil ply and prevent it from being torn or punctured as cavities are cold formed in the laminate. After the cavities are formed, tablets or pills can be placed in them and the other sheet, which is typically a two ply aluminum foil/plastic sheet laminate, is overlaid onto and sealed to the tablet carrying sheet as a cover to complete the blister package.

The aluminum foil ply in the cover sheet is typically somewhat thinner (e.g., about 0.02 millimeters) and therefore not as strong as the aluminum foil ply in the tablet carrying sheet which typically has a thickness of about 0.04 millimeters. This enables the pills or tablets to be removed by manually pushing them through and rupturing the cover sheet.

These types of blister packages are uneconomical to produce due to the high cost of the three ply laminate sheet. In addition, cold forming the cavities in the three ply laminate sheet must be done slowly and carefully to avoid tearing or puncturing the aluminum ply thereby decreasing production line output.

SUMMARY OF THE INVENTION

It has now been found that the shortcomings of these all aluminum-type blister packages can be overcome by the novel sandwich blister package of the invention. In general, the sandwich blister package of this invention comprises a sheet of plastic film having a plurality of heat-formed cavities; a two-ply plastic film/aluminum foil laminate sheet superimposed upon and sealed to the plastic film to form a first blister card of pre-set size; and, a second blister card bonded to said first blister card to complete the sandwich blister package with the aluminum foil forming the outer protective cover of said sandwich blister package.

Use of the heat-formable plastic film in the sandwich blister package of the invention reduces the cost of materials, eliminates the need for additional aluminum foil lamination, and permits faster package production since the cavities can be quickly heat formed in the plastic film. In addition, since only one ply of aluminum foil is used, the materials costs to produce the sandwich blister package of the invention are substantially reduced.

The plastic materials that can be used for the plastic film portion of the blister package of the invention are those which are resilient, heat formable and heat sealable such as polyvinyl chloride (PVC) polyvinylidine chloride, fluoro plastics, and the like, preferably PVC. PVC films having a thickness of from about 0.2 to about 0.25 millimeters provide the desired packaging and processing properties for use in the sandwich blister package of the invention and are commercially available. The PVC films can be readily heated to form the cavities for tablets or pills, retain the integrity of the formed cavities after cooling and are heat sealable.

The aluminum foil used in the two-ply laminate sheet of the invention sandwich blister package generally has a thickness of from about 20 to 25 microns, and is also commercially available. These types of aluminum foils are typically referred to as "lid" foils as they are generally used as temporary covers on bowls or pans to protect foods.

The PVC film laminated to the aluminum foil is typically about 0.02 millimeters thick.

Conventional packaging apparatus can be used to produce the sandwich blister package of the invention which generally comprises feeding a sheet of PVC plastic film over a heating plate having a plurality of spaced apertures formed therein; concurrently applying heat and vacuum to the PVC plastic sheet while it is held over the heating plate to vacuum form a plurality of spaced cavities in the PVC plastic sheet; advancing the PVC plastic sheet and filling the cavities with pills or tablets; superimposing a two ply plastic film/aluminum foil laminate sheet over the filled cavities; bonding the plastic film/aluminum foil laminate to the PVC plastic sheet; cutting the thusly bonded members to obtain separate blister cards of pre-set sizes, each containing a pre-determined quantity of tablets or pills; and, superimposing pairs of said blister cards on each other and bonding them to each other by heat sealing them together so that the aluminum foil portion of the two ply laminate forms the outer protective cover with the plastic films and tablets sandwiched therebetween.

DETAILED DESCRIPTION OF THE INVENTION

The sandwich blister package of the invention and a method for producing it will become more clear from the ensuing description when considered together with the accompanying drawing wherein like reference numerals identify like parts and wherein.

Figure 1:
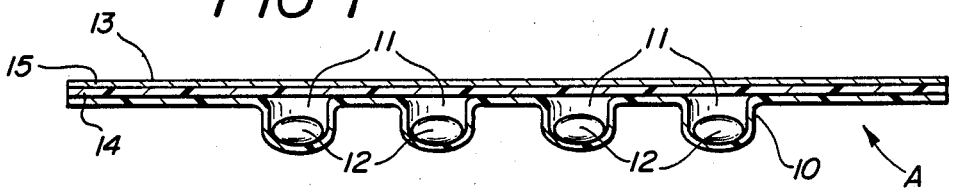
FIG. 1 is an exaggerated side elevation illustrating one blister card of the sandwich blister package of the invention.

As shown in FIG. 1, one blister card of the sandwich blister package of the invention is generally identified by reference letter A and comprises a PVC plastic sheet 10 having a plurality of cavities 11 heat formed therein and in which have been placed a pill or tablet 12. Superimposed upon and bonded to PVC sheet 10 is two ply laminate 13 consisting of an inner ply of PVC plastic film 14 and an outer ply of aluminum foil 15.

Figure 2:
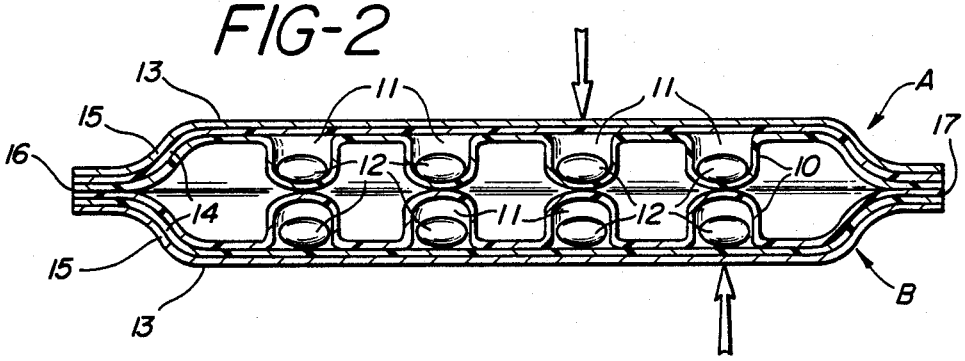
FIG. 2 is an exaggerated side elevation illustrating two blister cards bonded together to form the sandwich blister package of the invention.

In FIG. 2, an assembled sandwich blister package of the invention, is shown comprising blister card A of FIG. 1 and a second blister card generally identified by reference letter B. Blister card B is a duplicate of blister card A as indicated by like reference numerals identifying like parts. Blister card A is overlaid onto blister card B and they are bonded; i.e., heat sealed, to each other in the area of their common overlapping edges as indicated at 16 and 17.

The sandwich blister package thus formed consists of the tablets or pills 12 contained in the cavities 11 of PVC plastic sheet 10 sandwiched between and enveloped by the outer plies of aluminum foil 15 which serves as the moisture/vapor/gas impervious material. Thus, the pills or tablets 12 are maintained in a stable condition for prolonged periods retaining their full potency until they are removed for consumption.

To remove a pill or tablet 12 from the assembled package shown in FIG. 2, finger pressure can be applied against a pill or tablet on either side of the package as shown by the blocked arrows until the pill opposite the point of applied pressure is pushed through its adjacent two ply laminate.

Figure 3:
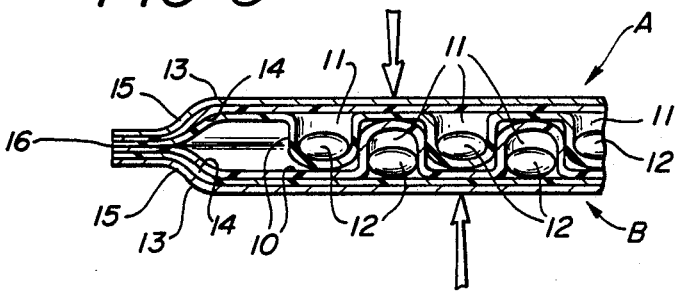
FIG. 3 is a view similar to FIG. 2 illustrating another configuration for bonding two blister cards together.

In the assembled sandwich blister package shown in FIG. 3, blister card A is overlaid onto blister card B so that the cavities 11 of blister card A are off-set from those of blister card B in an intermeshing fashion. To remove a pill or tablet from this package configuration, finger pressure can be applied directly against the pill or tablet to be removed as shown by the blocked arrows until the pill or tablet is pushed through its adjacent two ply laminate.

Figure 4:
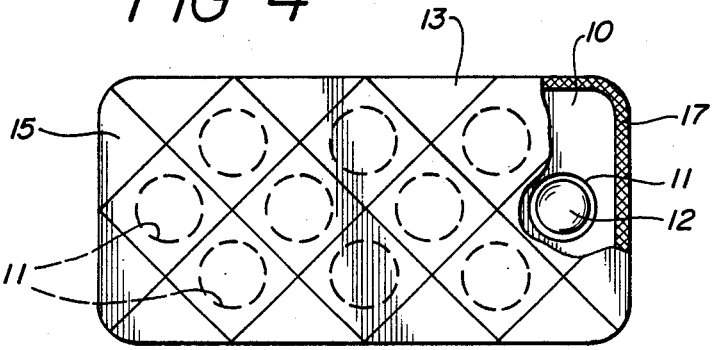
FIG. 4 is a top plan view of another embodiment of the sandwich blister package of the invention, one corner of which is broken away to illustrate another sealing configuration.

In the sandwich blister package shown in Fig 4, the common, overlapping edges of the two blister cards are heat sealed to each other as shown by peripheral cross-hatching 17 so that the two ply laminate 13 can be peelably removed from the underlying PVC plastic sheet 10 until a pill or tablet 12 is exposed for removal.

Figure 5:
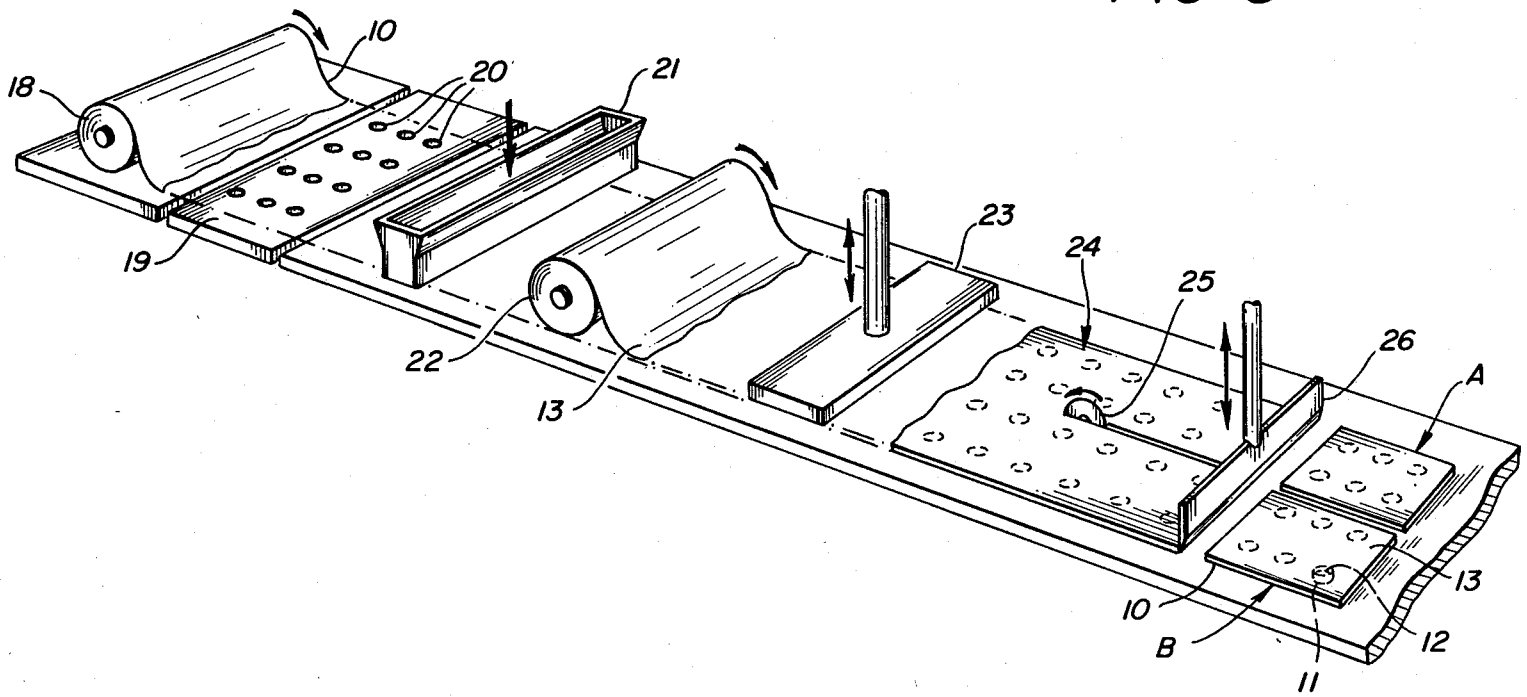
FIG. 5 is a perspective view schematically illustrating one method that can be used to produce the sandwich blister package of the invention using conventional means and apparatus.

FIG. 5 illustrates an assembly line method that can be used to continuously produce completed blister packages of the invention. As can be seen in FIG. 5, PVC film 10 can be continuously supplied in sheet form from a roll of PVC film 18 and led over a hot plate 19 having a plurality of spaced apertures 20. Hot plate 19 is kept at a temperature sufficient to heat the PVC sheet 10 so that it becomes softened and heat formable. When PVC sheet 10 has reached a softened, heat formable state (usually within about 2 seconds to about 6 seconds) vacuum is applied by conventional means (not shown) to draw the softened PVC sheet film 10 down into apertures 20 to thereby form the cavities 11 in the PVC sheet 10. The PVC sheet 10 is then fed beneath a pill or tablet supply means such as hopper 21 where a pill or tablet is deposited in each cavity. Sufficient distance from the cavity forming operation and the hopper 21 should be provided so that the cavities formed have time to cool, set and become integral. Usually, the cavities are set and cooled to maintain an integral self-supporting shape within about 2 seconds to about 6 seconds.

Downstream from hopper 21, two ply laminate 13 consisting of the aluminum foil ply and the PVC film ply is fed from laminate supply roll 22 to be superimposed upon the PVC sheet 10 carrying the pills or tablets in its cavities. Two-ply laminate 13 is then heat sealed to the PVC sheet 10 such as by means of heat sealing platen 23 to obtain an elongated blister package assemblage. Conventional knife blades, such as those respectively shown at 25 and 26, can then be used to cut the elongated blister package assemblage 24 into individual blister cards A and B of pre-set sizes so that each blister card is the same size and contains a pre-determined number of pills or tablets. Blister cards A and B are then fed to downstream stations (not shown) where one blister card is first overlaid upon another blister card and the common overlapping edges of the blister cards are heat sealed to each other to produce the sandwich blister package of the invention.

What is claimed:

1. A sandwich blister package comprising a first and a second blister card, each blister card consisting essentailly of:

(a) a plastic sheet having a plurality spaced cavities formed therein of sufficient size and depth to contain a pill or tablet; and.

(b) a two-ply laminate comprising an inner plastic film ply and an outer aluminum foil ply, said laminate being superimposed over said cavities and bonded to said plastic sheet, said first blister card being overlaid upon said second blister card with the overlapping common edges of said first and second blister cards heat sealed to each other such that the aluminum foil plies of each of said blister cards envelopes and sandwiches therebetween said plastic sheet and said plastic film ply thereby providing a moisture/vapor/gas impervious barrier for said pills or tablets

2. The sandwich blister package of claim 1 wherein said plastic sheet is a sheet of polyvinyl chloride film having a thickness of from about 0.2 to about 0.25 milimeters.

3. The sandwich blister package of claim 1 wherein said aluminum foil has a thickness of from about 20 microns to about 25 microns.

4. The sandwich blister package of claim 1 wherein said plastic film ply is said two ply laminate has a thickness of about 0.02 millimeters.

5. The sandwich blister package of claim 1 wherein said first and second blister cards are bonded to each other such either of said two ply laminates can be peelably removed from their respective plastic sheets.

6. A sandwich blister package comprising:

a first and second blister card, each blister card consisting essentially of (a) a polyvinyl chloride sheet having a plurality of spaced cavities formed therein of sufficient size and depth to contain a pill or tablet, said sheet having a thickness of from about 0.2 to about 0.25 millimeters; and, (b) a two ply laminate comprising an inner polyvinylchloride film ply and an outer aluminum foil ply, said polyvinylchloride film ply having a thickness of about 0.02 millimeters and said aluminum foil ply having a thickness of from about 20 to about 25 microns, said laminate being superimposed over said cavities and heat sealed to said polyvinyl chloride sheet, said first blister card being overlaid upon said second blister card and the blister cards heat sealed to each other in their common, overlapping edges such that the aluminum foil plies of each of said blister cards envelopes and sandwiches therebetween said polyvinyl chloride sheet and said polyvinylchloride film thereby providing a moisture/vapor/gas impervious barrier for said pills or tablets 7. The sandwich blister package of claim 6 wherein said first and second blister cards are heat sealed together such that either of said two-ply laminates can be peelably removed from their respective polyvinyl chloride sheets.

* * * * *